US009404511B2

(12) United States Patent
Van Houten

(10) Patent No.: US 9,404,511 B2
(45) Date of Patent: Aug. 2, 2016

(54) FREE-TIPPED AXIAL FAN ASSEMBLY WITH A THICKER BLADE TIP

(71) Applicant: Robert Bosch GmbH, Stuttgart (DE)

(72) Inventor: Robert J. Van Houten, Winchester, MA (US)

(73) Assignee: Robert Bosch GmbH, Stuttgart (DE)

( * ) Notice: Subject to any disclaimer, the term of this patent is extended or adjusted under 35 U.S.C. 154(b) by 431 days.

(21) Appl. No.: 13/964,872

(22) Filed: Aug. 12, 2013

(65) Prior Publication Data

US 2014/0271172 A1 Sep. 18, 2014

Related U.S. Application Data

(60) Provisional application No. 61/779,186, filed on Mar. 13, 2013.

(51) Int. Cl.
*F04D 29/68* (2006.01)
*F04D 29/38* (2006.01)

(52) U.S. Cl.
CPC ..... *F04D 29/681* (2013.01); *F04D 29/384* (2013.01); *F05D 2240/307* (2013.01)

(58) Field of Classification Search
CPC . F04D 2240/307; F04D 29/384; F04D 29/68; F04D 29/38; F04D 29/681
See application file for complete search history.

(56) References Cited

U.S. PATENT DOCUMENTS 5,064,345 A * 11/1991 Kimball ..... F04D 29/386 416/169 A
5,181,830 A 1/1993 Chou
6,113,353 A 9/2000 Sato et al.
6,241,474 B1 * 6/2001 Alizadeh ..... F04D 29/384 416/189
6,626,640 B2 9/2003 Ivanovic
6,648,598 B2 * 11/2003 Mimura ..... F04D 29/384 415/220
6,796,771 B2 * 9/2004 Suzuki ..... F04D 29/384 416/228
7,438,522 B2 10/2008 Eimer
7,559,744 B2 7/2009 Suzuki et al.
7,564,684 B2 7/2009 Luo
8,083,479 B2 12/2011 Lin (Continued)

FOREIGN PATENT DOCUMENTS

DE 3017226 A1 * 11/1980 ..... F04D 29/384
DE 3217085 11/1983

(Continued)

OTHER PUBLICATIONS

International Search Report for International Appl. No. PCT/2014/020985, dated Jun. 26, 2014, 5 pages.

(Continued)

*Primary Examiner* — Mary A Davis
(74) *Attorney, Agent, or Firm* — Michael Best & Friedrich LLP

(57) ABSTRACT

A free-tipped axial fan assembly includes a fan having a blade tip geometry which minimizes the adverse effect of a tip gap. The maximum blade thickness exhibits a significant increase adjacent the blade tip. In some constructions, the maximum thickness at the blade tip is at least 100 percent greater than the maximum thickness 0.10 R away from the blade tip. In some constructions, the trailing-edge thickness at the blade tip is approximately the same as the trailing-edge thickness 0.10 R away from the blade tip. In some constructions, the increase in blade thickness follows the square of the distance from the position where the increase begins.

20 Claims, 12 Drawing Sheets

(56) References Cited

U.S. PATENT DOCUMENTS

| | | | | |
|---|---|---|---|---|
| 8,231,343 | B2 | 7/2012 | Kayama et al. | |
| 8,277,180 | B2 | 10/2012 | Blass et al. | |
| 8,348,612 | B2 * | 1/2013 | Brittingham | F01D 5/225 416/191 |
| 9,004,860 | B2 * | 4/2015 | Van Houten | F04D 29/384 415/222 |
| 9,017,036 | B2 * | 4/2015 | Straccia | F01D 5/141 416/242 |
| 2003/0123987 | A1 | 7/2003 | Longet | |
| 2006/0210397 | A1 | 9/2006 | Eimer | |
| 2008/0152502 | A1 | 6/2008 | Luo | |
| 2009/0311101 | A1 * | 12/2009 | Moreau | F04D 29/384 416/179 |
| 2010/0092286 | A1 | 4/2010 | Yamamoto et al. | |
| 2010/0126206 | A1 * | 5/2010 | Park | F04D 29/30 62/419 |

FOREIGN PATENT DOCUMENTS

| | | | |
|---|---|---|---|
| DE | 3304297 | 3/1984 | |
| GB | 1491556 | 11/1977 | |
| WO | WO 2011106658 A1 * | 9/2011 | F04D 29/384 |

OTHER PUBLICATIONS

International Written Opinion for International Appl. No. PCT/2014/020985, dated Jun. 26, 2014, 5 pages.

* cited by examiner

SECTION A-A

FREE-TIPPED AXIAL FAN ASSEMBLY WITH A THICKER BLADE TIP

CROSS-REFERENCE TO RELATED APPLICATIONS

This application claims priority to U.S. Provisional Patent Application No. 61/779,186 filed Mar. 13, 2013, the entire contents of which are incorporated by reference herein.

BACKGROUND

This invention relates generally to free-tipped axial-flow fans, which may be used as automotive engine-cooling fans, among other uses.

Engine-cooling fans are used in automotive vehicles to move air through a set of heat exchangers which typically includes a radiator to cool an internal combustion engine, an air-conditioner condenser, and perhaps additional heat exchangers. These fans are generally enclosed by a shroud which serves to reduce recirculation and to direct air between the fan and the heat exchangers. Typically, these fans are powered by an electric motor which is mounted to the shroud.

The fans are typically injection-molded in plastic, a material with limited mechanical properties. Plastic fans exhibit creep deflection when subject to rotational and aerodynamic loading at high temperature. This deflection must be accounted for in the design process.

Although some engine-cooling fans have rotating tip bands connecting the tips of all the blades, many are free-tipped—i.e., the tips of the blades are free from connection with one another. Free-tipped fans have several advantages when compared to banded fans. They can have lower cost, reduced weight, better balance, and advantages due to their reduced inertia, such as lower couple imbalance, lower precession torque, and faster coast-down when de-powered.

Often free-tipped fans are designed to have a constant-radius tip shape, and to operate in a shroud barrel which is cylindrical in the area of closest clearance with the fan blades. In other cases, the tip radius is non-constant. For example, U.S. Pat. No. 6,595,744 describes a free-tipped engine-cooling fan in which the blade tips are shaped to conform to a flared shroud barrel.

Free-tipped fans are designed to have a tip gap, or running clearance, between the blade tips and the shroud barrel. This tip gap must be sufficient to allow for both manufacturing tolerances and the maximum deflection that may occur over the service life of the fan assembly. In practice, this gap is generally at least 0.5 percent, but less than 2 percent of the fan diameter, and more typically approximately 1 percent of fan diameter.

The presence of a tip gap has numerous adverse effects on performance. One effect is that as the gap increases the fan must operate at higher speeds to achieve a given operating point. This is due to the fact that the blade loading—the pressure differential between the pressure and suction sides of the fan blade—is reduced in the vicinity of the gap. Other effects are reduced fan efficiency and increased fan noise, particularly when the system resistance is high. These adverse effects can limit the applicability of free-tipped fans to applications where the system resistance is relatively low. Thus, there is a need for a free-tipped fan which minimizes adverse performance effects caused by the tip gap.

One approach is to design the fan so as to counteract the effect of the tip gap on the fan loading. For example, U.S. Patent Application Publication No. 2011/0211949 describes a fan with improved tip loading in the presence of a tip gap.

This fan can improve fan performance, but the efficiency and noise of the fan may still be compromised by the gap.

Another approach is to design the tip of the fan in such a way that the flow of air through the gap is minimized. Various methods have been proposed in the past, with varying success. The challenge is to modify the blade shape in such a way that the flow through the tip gap is minimized, without adding geometric details which contribute additional parasitic drag or increase the noise of the fan.

SUMMARY

In one aspect, the invention provides a free-tipped axial fan assembly comprising a fan and a shroud, the fan having a plurality of blades, each blade having a leading edge, a trailing edge, and a blade tip. The shroud comprises a shroud barrel surrounding at least a portion of the blade tips, the assembly having a running clearance between the shroud barrel and the blade tips. The fan has a blade tip radius R equal to the maximum radial extent of the blade tips measured at the blade trailing edge, and a diameter D equal to twice the blade tip radius R. Each of the blades has a sectional geometry which at each radius has a chord line and a thickness distribution, said thickness varying from the blade leading edge to the blade trailing edge, said thickness having a maximum value at a position of maximum thickness. A non-dimensional thickness distribution is defined at each radius to be the distribution of thickness divided by maximum thickness as a function of chordwise position. The maximum thickness of each of the plurality of blades exhibits a significant increase in a region adjacent the blade tip.

In one aspect of the invention, the shroud barrel is flared, and the blade tips are shaped to conform to the flared shroud barrel, and the blade tip leading edge is at a larger radius than the blade tip trailing edge. In this aspect of the invention, the maximum thickness, the trailing-edge thickness, and the thickness distribution at any distance from the blade tip within the region adjacent the blade tip are taken to be the maximum thickness, the trailing edge thickness, and the thickness distribution of a blade with a maximum thickness, a trailing-edge thickness, and a thickness distribution which does not vary with radial position, the intersection of which by a surface of revolution offset by said distance from the surface of revolution swept by the blade tip is identical to that of the blade.

In another aspect of the invention, the fan has constant-radius blade tips.

In another aspect of the invention, the maximum thickness at each blade tip is at least 100 percent greater than the maximum thickness of a blade section which is offset from the blade tip by a distance equal to 0.10 R.

In another aspect of the invention, the maximum thickness at each blade tip is at least 200 percent greater than the maximum thickness of a blade section which is offset from the blade tip by a distance equal to 0.10 R.

In another aspect of the invention, the maximum thickness at each blade tip is at least 100 percent greater than the maximum thickness of a blade section which is offset from the blade tip by a distance equal to 0.05 R.

In another aspect of the invention, the maximum thickness at each blade tip is at least 200 percent greater than the maximum thickness of a blade section which is offset from the blade tip by a distance equal to 0.05 R.

In another aspect of the invention, the maximum thickness at each blade tip is at least 100 percent greater than the maximum thickness of a blade section which is offset from the blade tip by a distance equal to 0.025 R.

In another aspect of the invention, the maximum thickness at each blade tip is at least 200 percent greater than the maximum thickness of a blade section which is offset from the blade tip by a distance equal to 0.025 R.

In another aspect of the invention, there is a smooth transition in thickness between an inner portion of the blade and the region of significant maximum thickness increase adjacent the blade tip.

In another aspect of the invention, the thickness increases monotonically to the blade tip within the region of significant maximum thickness increase adjacent the blade tip.

In another aspect of the invention, the increase in maximum thickness follows approximately the square of the distance from a position corresponding to a beginning of the thickness increase.

In another aspect of the invention, the non-dimensional thickness distribution at the blade tip is similar to the non-dimensional thickness distribution at the beginning of the thickness increase, with the exception of the trailing edge region, where the blade tip has a relatively small non-dimensional trailing-edge thickness.

In another aspect of the invention, the non-dimensional thickness distribution at the blade tip has a position of maximum thickness which is closer to the trailing edge than that of the non-dimensional thickness distribution at the beginning of the thickness increase.

In another aspect of the invention, the trailing-edge thickness of the blade tip is approximately equal to the trailing-edge thickness of the blade section at a position corresponding to a beginning of the thickness increase.

In another aspect of the invention, the tip gap is greater than 0.005 times the fan diameter D and less than 0.02 times the fan diameter D.

In another aspect of the invention, the fan is injection-molded plastic.

In another aspect of the invention, the thickened region adjacent to the blade tip is hollow.

In another aspect of the invention, the shroud barrel is flared, the blade tips are shaped to conform to the flared shroud barrel, the fan is injected-molded, and the thickened region adjacent to the blade tip is hollowed in such a way that action in the molding die is not required.

In one aspect, the invention provides a free-tipped axial fan assembly comprising a fan and a shroud, the fan having a plurality of blades, each blade having a leading edge, a trailing edge, and a blade tip. The shroud comprises a shroud barrel surrounding at least a portion of the blade tips, the assembly having a running clearance between the shroud barrel and the blade tips. The fan has a blade tip radius R equal to the maximum radial extent of the blade tips measured at the blade trailing edge, and a diameter D equal to twice the blade tip radius R. Each of the blades has a sectional geometry which at each radius has a chord line and a thickness distribution, said thickness varying from the blade leading edge to the blade trailing edge, said thickness having a maximum value at a position of maximum thickness. A non-dimensional thickness distribution is defined at each radius to be the distribution of thickness divided by maximum thickness as a function of chordwise position. The maximum thickness of each of the plurality of blades exhibits a significant increase in a region adjacent the blade tip and the maximum thickness increases continuously from an end of the region furthest from the blade tip to either a sharp blade tip edge or a point where edge-rounding of the blade tip begins.

Other aspects of the invention will become apparent by consideration of the detailed description and accompanying drawings.

BRIEF DESCRIPTION OF THE DRAWINGS

FIG. 6*a* shows the intersection with a meridional plane of several surfaces of revolution and FIG. 6*b* shows the thickness increase at the blade sections cut by those surfaces of revolution.

FIG. 10*a* shows a meridional section through the tip region of a blade and the shroud barrel, at an angle corresponding to the point of maximum thickness at the blade tip, as indicated in FIG. 10*b*. FIG. 10*b* is an axial view of the pressure side of the blade tip region.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
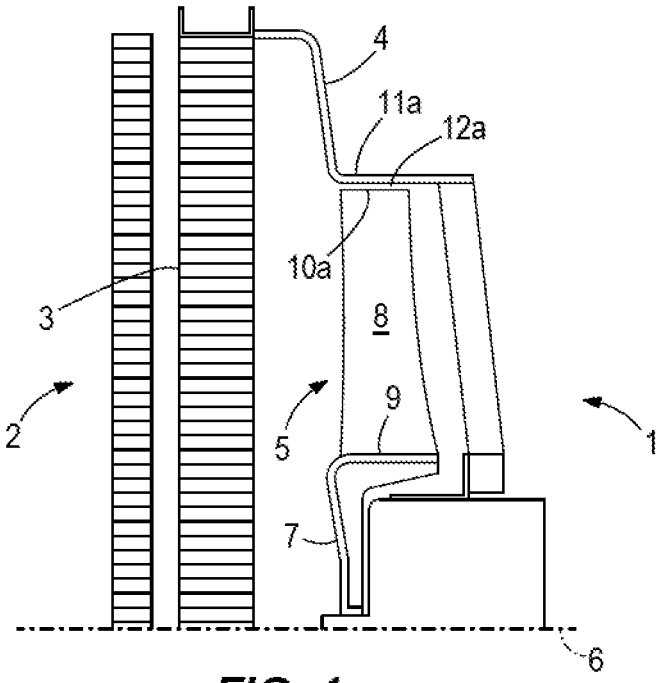
FIG. 1*a* is a schematic view of a free-tipped axial fan assembly, showing a constant-radius blade tip and a cylindrical shroud barrel. The free-tipped axial fan assembly is configured as an engine-cooling fan assembly.

FIG. 1*a* shows a free-tipped axial fan assembly 1. In the illustrated construction, the free-tipped axial fan assembly 1 is an engine-cooling fan assembly mounted adjacent to at least one heat exchanger 2. In some constructions, the heat exchanger(s) 2 includes a radiator 3, which cools an internal combustion engine (not shown) as fluid circulates through the radiator 3 and back to the internal combustion engine. In alternatively-powered vehicles, the fan assembly 1 could be used in conjunction with one or more heat exchangers to cool batteries, electric motors, etc. A shroud 4 guides cooling air from the radiator 3 to a fan 5. The fan 5 rotates about an axis 6 and comprises a hub 7 and a plurality of generally radially-extending blades 8. FIG. 1*a* shows the meridional area swept by these blades as the fan rotates. The end of each blade 8 that is adjacent to the hub 7 is a blade root 9, and the outermost end of each blade 8 is a blade tip 10*a*. The blade tips 10*a* are surrounded by a barrel 11*a* of the shroud 4. A tip gap 12*a* provides a running clearance between the blade tips 10*a* and the shroud barrel 11*a*.

Although the fan 5 may be in a "puller" configuration and located downstream of the heat exchanger(s) 2, in some cases the fan 5 is a "pusher", and located upstream of the heat exchanger(s) 2. Although FIG. 1*a* represents most accurately a puller configuration, it could be interpreted as a pusher, although in such a configuration, the position of the radiator 3 within the set of heat exchangers 2 would typically be reversed.

FIG. 1*a* shows each blade tip 10*a* to be at a constant radius, and the shroud barrel 11*a* to be generally cylindrical in the region of close proximity to the blade tips 10*a*. This example shows the blade tips 10*a* in close proximity with the shroud barrel 11*a* along their entire axial length. In other cases, the blade tips 10*a* are allowed to protrude from the barrel 11*a*, so that only the rearward portion of each blade tip 10*a* has a small clearance gap with the shroud barrel 11*a*.

Figure 2C:
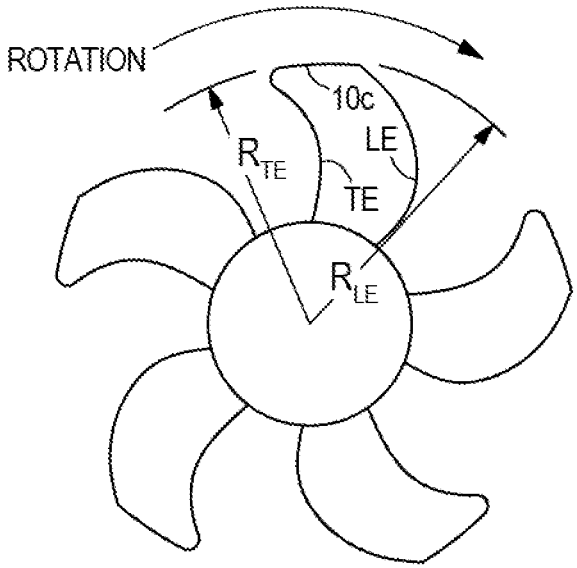
FIG. 2*c* shows an axial projection of a fan with a blade tip which conforms to a flared shroud, where the blade trailing edge is rounded at the blade tip.
Figure 2A:
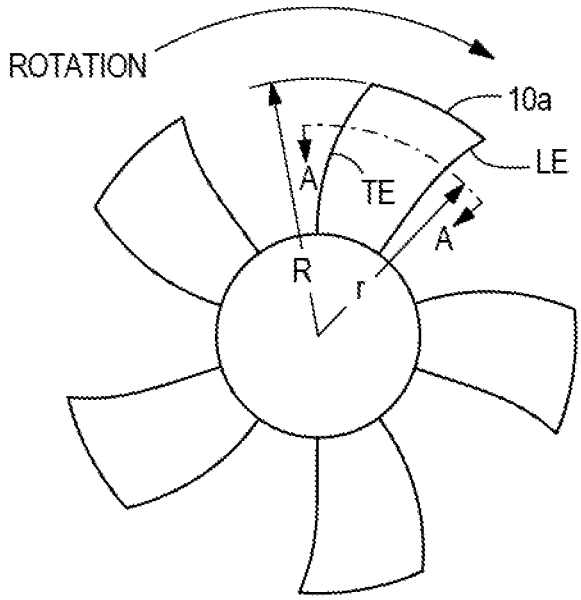
FIG. 2*a* shows an axial projection of a fan with a constant-radius blade tip, with definitions of various geometric parameters.

FIG. 2*a* is an axial projection of the free-tipped fan of FIG. 1*a* having a constant-radius blade tip 10*a*. The rotation is clockwise in the drawing, and the fan leading edge LE and trailing edge TE are as shown. The overall fan radius is equal to the blade tip radius R. The parameters describing the geometry of the blade are defined as a function of radial position r, which can be non-dimensionalized on the blade tip radius R. Blade sectional geometry is defined in terms of cylindrical sections such as that indicated by section A-A.

Figure 1B:
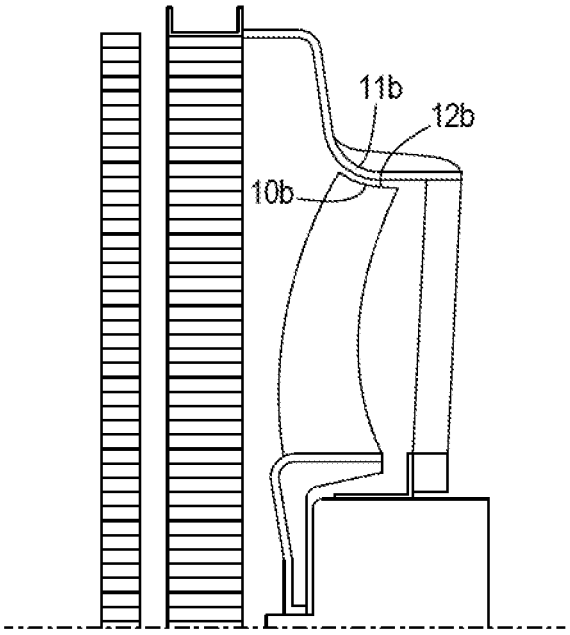
FIG. 1*b* is a schematic view of a free-tipped axial fan assembly, showing a blade tip which conforms to the shape of a flared shroud barrel. The free-tipped axial fan assembly is configured as an engine-cooling fan assembly.

FIG. 1*b* illustrates a free-tipped axial fan assembly that is configured as an engine-cooling fan assembly similar to that of FIG. 1*a*, with the following exceptions. Rather than being substantially cylindrical, the shroud barrel 11*b* is flared, and the blade tips 10*b* conform to the flared shape of the shroud barrel 11*b*. A tip gap 12*b* provides running clearance.

Figure 2B:
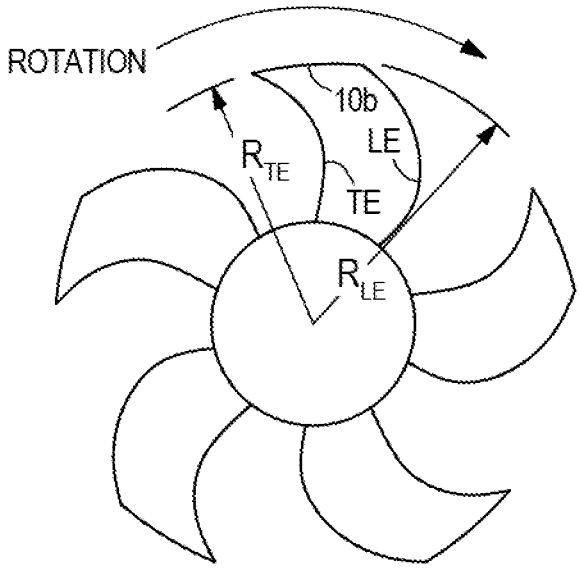
FIG. 2*b* shows an axial projection of a fan with a blade tip which conforms to a flared shroud, with definitions of various geometric parameters.

FIG. 2*b* shows an axial view of the free-tipped fan of FIG. 1*b* in which the blade tips 10*b* conform to a flared shroud 11*b*. The radius of each blade tip 10*b* at the leading edge LE is $R_{LE}$ and at the trailing edge TE is $R_{TE}$, where $R_{LE}$ exceeds $R_{TE}$. In the case of a fan with flared blade tips, the trailing edge radius $R_{TE}$ is considered to be the nominal blade tip radius. Thus, in the following description where "blade tip radius" or "blade tip radius R" is used, this can refer to either the constant blade tip radius of a fan with non-flared blade tips or the nominal blade tip radius of a fan with flared blade tips.

Figure 1C:
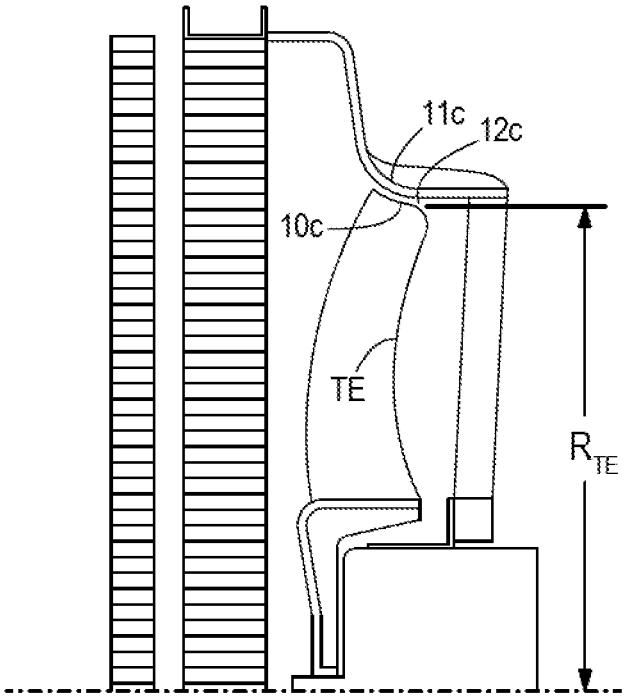
FIG. 1*c* is a schematic view of a free-tipped axial fan assembly, showing a blade tip which conforms to the shape of a flared shroud barrel, where the blade trailing edge is rounded at the blade tip.

FIG. 1*c* illustrates a free-tipped axial fan assembly that is configured as an engine-cooling fan assembly similar to that of FIG. 1*b*, where the shroud barrel 11*c* is flared, and the blade tips 10*c* conform to the flared shape of the shroud barrel 11*c*. Here the trailing edge TE at the blade tip is locally rounded.

FIG. 2*c* shows an axial view of the free-tipped fan of FIG. 1*c* in which the blade tips 10*c* conform to a flared shroud 11*c*, and the blade trailing edge TE is rounded at the blade tips. The trailing-edge radius $R_{TE}$ of each blade tip 10*c* is taken to be the radius of the blade tip at the trailing edge TE where the blade tip is in close proximity to the flared shroud 11*c*. In the case of a fan with flared blade tips where the blade trailing edge is locally rounded, the trailing edge radius $R_{TE}$ is considered to be the nominal blade tip radius.

Unless specifically noted otherwise, the description below and the accompanying drawings refer generally to any of the types of fans shown in FIGS. 1*a*-2*c*. In the detailed description below, fan diameter D is taken to be two times the radius R as shown in FIG. 2*a*, or two times the trailing edge radius $R_{TE}$ as shown in FIGS. 2*b* and 2*c*. Tip gaps 12*a*, 12*b*, 12*c* may be expressed in terms of fan diameter for any of the types of fans shown in FIGS. 1*a*-2*c*. At the axial position where it is a minimum, the tip gap 12*a*, 12*b*, 12*c* between the blade tip 10*a*, 10*b*, 10*c* and the shroud barrel 11*a*, 11*b*, 11*c* is between about 0.005 and about 0.02 times the fan diameter D. FIGS. 1*a*, 1*b* and 1*c* show the tip gaps 12*a*, 12*b*, and 12*c* to be approximately 0.01 times the fan diameter D.

Figure 3A:
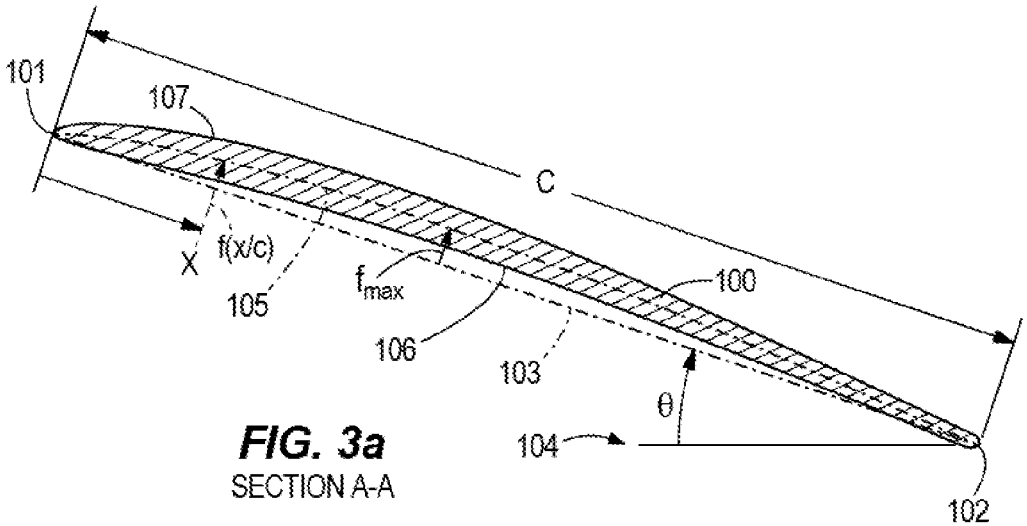
FIG. 3*a* is a cylindrical cross-section of a fan blade, taken along line A-A of FIG. 2*a*, with definitions of various geometric parameters.

FIG. 3*a* shows cylindrical cross-section A-A at radius r of the fan shown in FIG. 2*a*. The blade section 100 has a leading edge 101 and a trailing edge 102. A chord line 103 is a straight line between the leading edge 101 and the trailing edge 102. The length of the chord line is defined as the chord c. Blade angle θ is defined as the angle between the rotation plane 104 and the chord line 103. A mean line 105 of the blade is defined as the line that lies midway between opposed "lower" and "upper" surfaces 106, 107. More precisely, the distance from a point on the mean line 105 to the upper surface 107, measured normal to the mean line 105, is equal to the distance from that point on the mean line 105 to the lower surface 106, measured normal to the mean line 105. The geometry of the mean line 105 can be described as a function of chordwise position x/c, where the distance x along the chord line 103 is divided by the chord c. For example, the camber fat any chordwise position x/c is the distance between the chord line 103 and the mean line 105 at that position, measured normal to the chord line 103. The maximum camber (or "max camber") $f_{max}$ at any radius r is the largest value of camber fat that radius r.

Figure 3B:
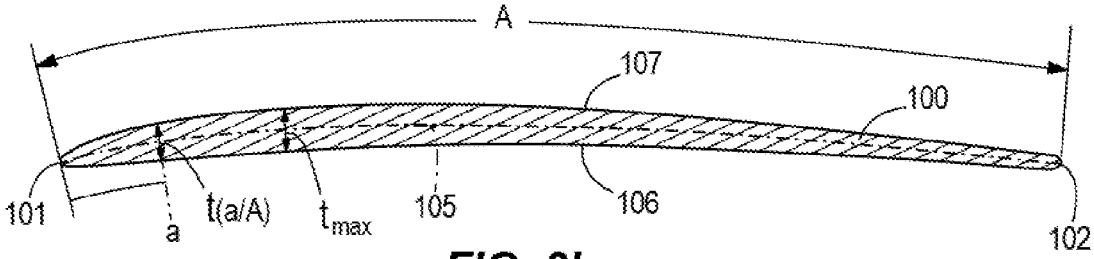
FIG. 3*b* is a cylindrical cross-section of a fan blade with definitions of other geometric parameters.

FIG. 3*b* shows the blade section with zero blade angle. The meanline arclength is defined as "A". The blade thickness "t" at any position "a" along the mean line 105 is the distance between the upper surface 107 and the lower surface 106, measured normal to the mean line at that position. The thickness can be specified as a function of position along the mean line (meanline position, a/A), or as a function of chordwise position, x/c, where "x" is the position along the chord line intersected by a line normal to the chord line that passes through position "a" along the mean line. The blade thickness t can vary from the leading edge 101 to the trailing edge 102 and has a maximum value $t_{max}$, which occurs at a position $a_{tmax}$ along the meanline, or $x_{tmax}$ along the chord line. A non-dimensional thickness distribution can be defined as the distribution of $t/t_{max}$ as a function of meanline position a/A or chordwise position x/c. For small values of $f_{max}$, these two distributions are very nearly the same, and will be referred to indiscriminately in the following.

Figure 3C:
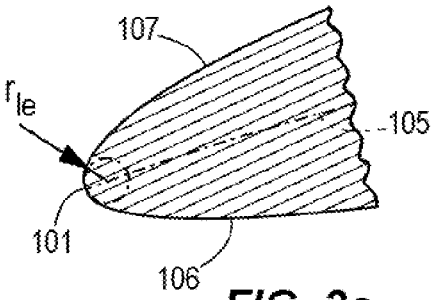
FIG. 3*c* is a detail of the leading-edge region of a fan blade.
Figure 3D:
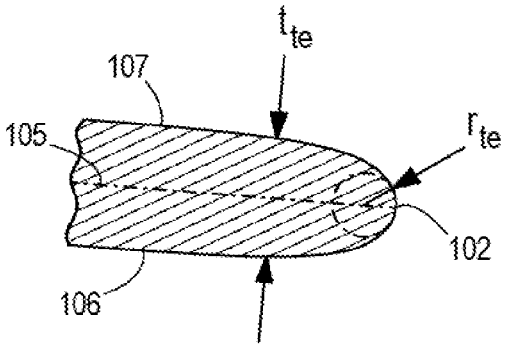
FIG. 3*d* is a detail of the trailing-edge region of a fan blade.

FIG. 3*c* shows a detail of the leading edge region of the blade. The leading edge is typically rounded with a radius $r_{le}$, as shown. FIG. 3*d* shows a detail of the trailing edge region. The trailing edge can be rounded with radius $r_{te}$, as shown, or alternatively it can have another shape. In any case, the detailed shape is typically confined to a small region, and a trailing edge thickness $t_{te}$ can generally be defined as the thickness just outside of that region, and very near the trailing edge.

Figure 4C:
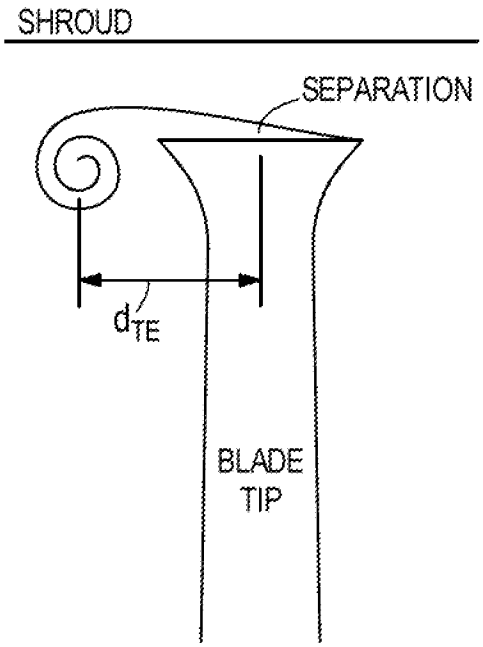
FIGS. 4*a*-4*c* are schematic views of leakage flow around blade tips of different geometries.

When a fan is operating, there exists a high pressure on the pressure side of the blade, and a low pressure on the suction side of the blade. At the tip of a free-tipped fan, this pressure difference causes there to be a leakage flow from the pressure side to the suction side. This leakage flow reduces the pressure difference across the blade tip, and causes a tip vortex to form adjacent to the suction surface. This tip vortex is shown schematically in FIG. 4*a*. This tip vortex is convected downstream and represents a loss of fan efficiency and a source of fan noise.

Various attempts have been made to reduce the amount of leakage. One obvious approach is to reduce the size of the tip gap. But manufacturing tolerances, wide-ranging environmental conditions, and anticipated blade creep all contribute to a required tip gap typically between 0.005 and 0.02 times the fan diameter D. Another approach is to attach a rotating tip band to the blade tips. This can be very effective, but banded fans can be more costly and less desirable due to their increased weight and inertia. "Partial" bands or "winglets" can be used, but it is difficult to design such extensions to the blade which do not increase fan noise due to misalignment of the geometry with the onset flow and the introduction of additional sources of "edge noise".

Figure 4B:
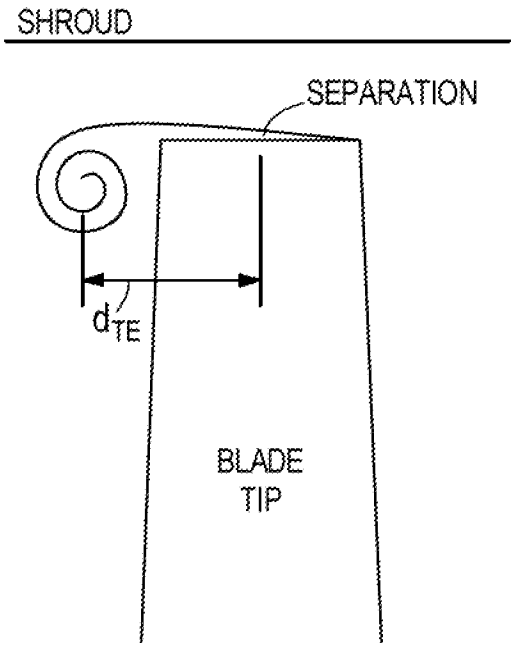
FIG. 4b PRIOR ART
Figure 4A:
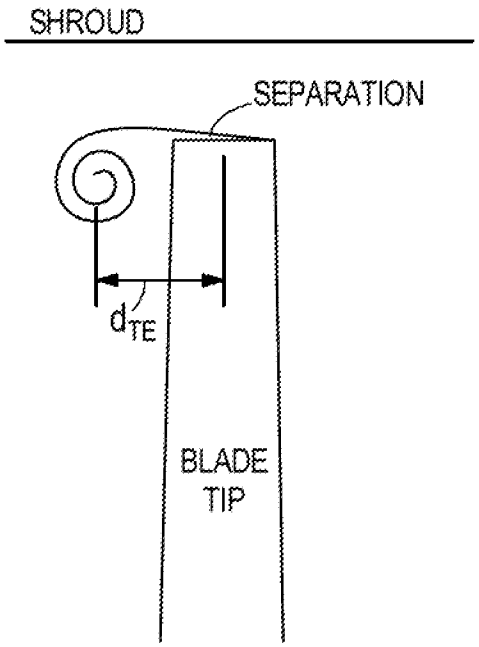
FIG. 4a PRIOR ART

One approach which has been found to reduce the adverse effects of a tip gap is to increase the thickness of the fan blade, as indicated in FIG. 4*b*. This may reduce the amount of leakage flow. It may also increase the distance $d_{TE}$ between the tip vortex and the blade tip trailing edge. The trailing edge is the region where pressure fluctuations due to boundary layer turbulence radiate as noise. If the tip vortex passes near the trailing edge, additional noise may be radiated. By displacing the tip vortex farther from the trailing edge, this noise mechanism may be reduced. Thickening the blade, however, has the disadvantages of increased cost and weight.

The current invention is shown schematically in FIG. 4*c*. Here the thickness of the fan blade is increased only in the region adjacent to the tip gap. The shape of the pressure surface of the blade may increase the extent of separation at the entrance to the tip gap, reducing the amount of leakage flow. The distance between the tip vortex and the blade trailing edge $d_{TE}$ may be similar to that distance in the case of the thickened blade, with similar noise benefits. An advantage of the current invention over the thickened blade is that the amount of additional material required is very small, resulting in minimal increases in weight and cost.

Figure 5A:
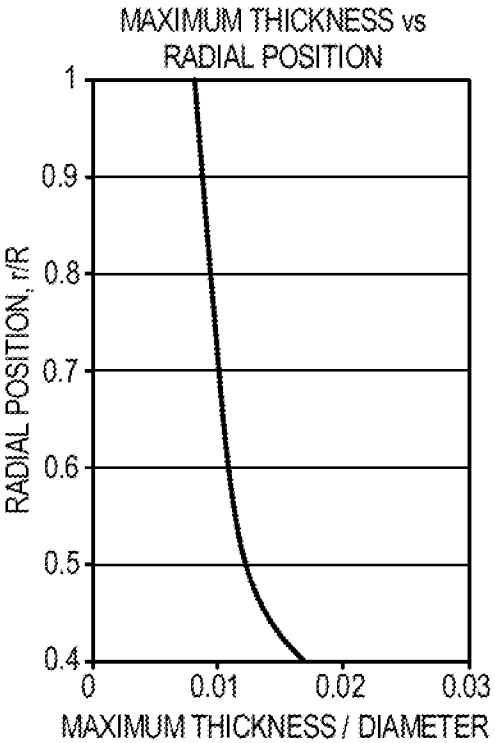
FIG. 5a PRIOR ART
FIGS. 5*a*, 5*b*, and 5*c* show plots of maximum thickness as a function of radius for a prior-art fan and two fans according to the present invention, in the case of a constant-radius blade tip.
Figure 5B:
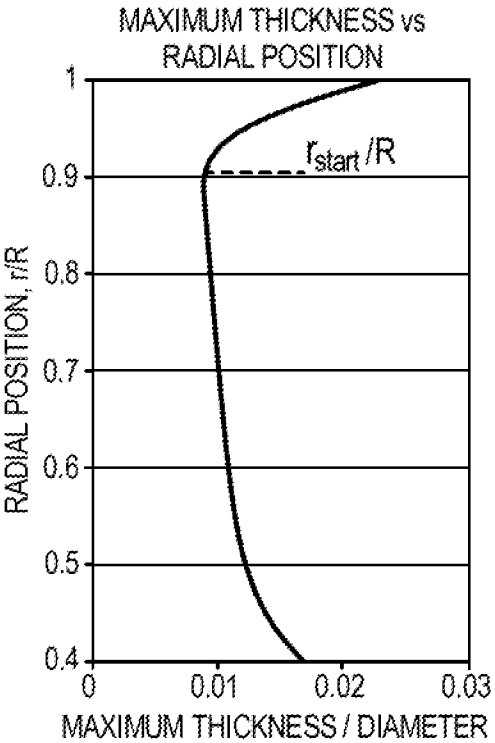
Figure 5C:
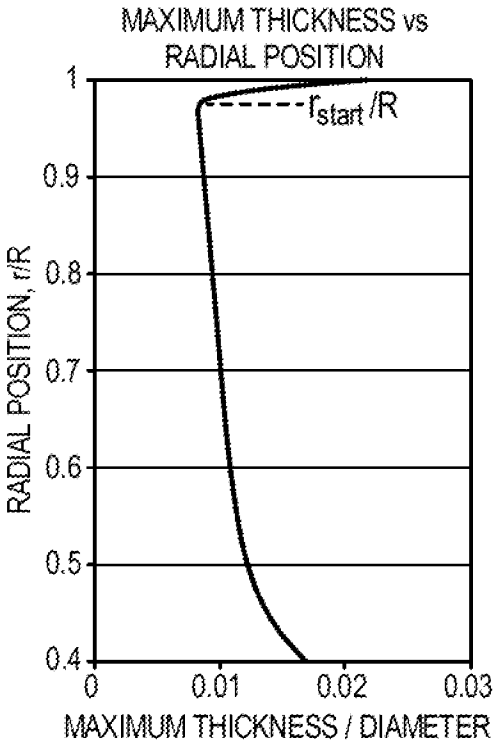

FIG. 5 is a plot vs radius of the maximum blade thickness $t_{max}$ in the case of a fan with a constant-radius blade tip, which would typically operate in a cylindrical shroud barrel. The blade root of this fan is at a radius equal to 0.4 times the fan radius R. FIG. 5*a* shows the thickness of a typical prior-art fan and FIGS. 5*b* and 5*c* show the thickness of fans according to the present invention. In all cases, the thickness is large at the root of the blade in order to reduce stress. As the radius increases, the thickness decreases smoothly to avoid stress concentration. At larger radii, the blade tapers approximately linearly. The prior-art blade continues this tendency to the blade tip. The blade according to the current invention tapers to within a small distance of the tip, at which point it increases quite rapidly. The radial position of the beginning of the thickness increase is shown as $r_{start}$ and the spanwise extent $\Delta s$ of the thickness increase is $(R-r_{start})$. In FIGS. 5*b* and 5*c*, $r_{start}/R$ is 0.9 and 0.975 and $\Delta s/R$ is 0.1 and 0.025, respectively. In FIGS. 5*b* and 5*c*, the increase in thickness follows the square of the radial distance from the beginning of the thickness increase, or $(r-r_{start})$. Such a distribution of thickness results in a smooth transition into the thickened region, and causes the thickness to be increasing rapidly at the blade tip. The resulting sharp edge at the pressure side of the blade tip may encourage the leakage flow to separate as it enters the tip gap, thereby reducing the total leakage flow.

In the case of a fan which has a constant-radius blade tip where the blade has the same distribution of non-dimensional thickness $t/t_{max}$ as a function of chordwise position x/c or meanline position a/A, FIG. 5 not only represents the radial distribution of the maximum blade thickness $t_{max}$, but also can be scaled to represent the thickness at other chordwise positions.

Although FIG. 5 shows a blade with a tapered distribution of maximum thickness outside the region of increased thickness adjacent the blade tip, other embodiments of the present invention have a thickness which is not tapered. For instance, in some embodiments the maximum thickness is approximately constant outside the region of increased thickness adjacent the blade tip. Also, although FIG. 5 shows a blade root at a radius equal to 0.4 times the fan radius R, other embodiments have blade roots at larger or smaller radial positions.

In the case of a fan whose blade tips conform to a flared shroud barrel, a preferred embodiment of the invention has a blade thickness distribution that varies not as a function of radius but as a function of distance from the blade tip. This is desirable because the flow near the shroud is roughly parallel to the shroud surface, encountering the blade leading edge at a radius larger than that at which it encounters the trailing edge. If the thickening of the blade occurs as a function of distance from the blade tip, the flow near the shroud experiences a blade shape whose thickness form is similar to the design thickness distribution. Were the thickness increase to occur as a function of radial position, the flow would encounter a relatively thick blade at the leading edge and a relatively thin blade at the trailing edge, giving rise to a blade surface pressure distribution significantly different from the design distribution. This, in turn, might give rise to less desirable boundary layer characteristics, and additional noise.

Figure 6A:
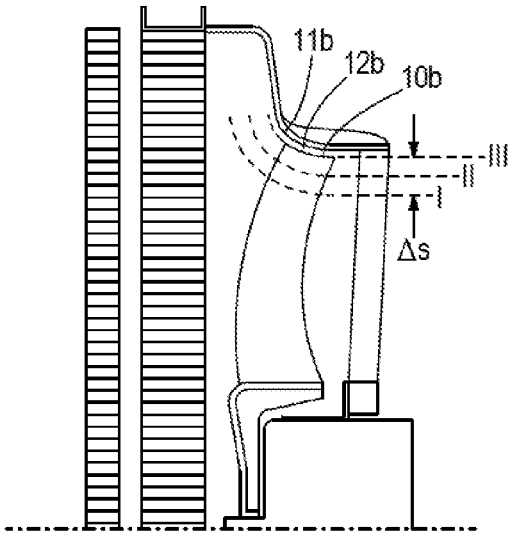
FIGS. 6*a* and 6*b* are schematic views showing the increase in maximum thickness as a function of distance from the blade tip in the case of a fan according to the present invention with a blade tip that conforms to a flared shroud barrel.
Figure 6B:
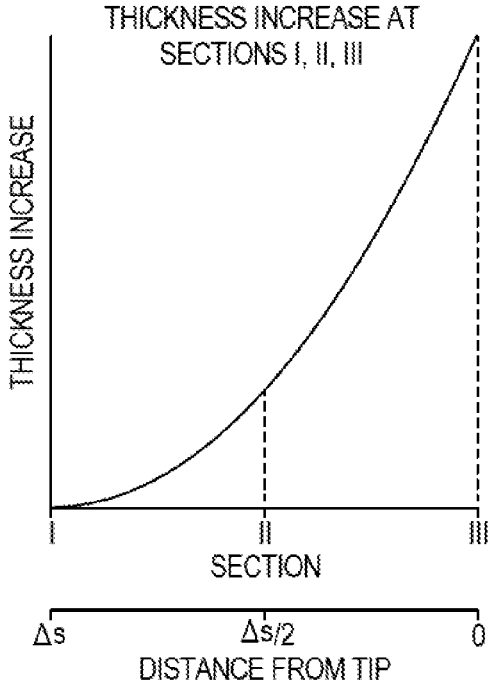

FIG. 6 is a schematic view showing a fan according to the present invention whose blade tips conform to a flared shroud barrel and where the thickness increase is a function of distance from the blade tip. FIG. 6*a* is a meridional section through the heat exchangers, shroud, and fan hub, and an outline of the swept area of a fan blade, where the dashed lines represent surfaces of revolution at different distances from the blade tip. Surface III contains the blade tip section, where the thickness increase is a maximum. Surface I is offset by a distance Δs from Surface III and is located at the start of the thickness increase. The distance Δs corresponds to the distance $R-r_{start}$ in the case of a fan according to the present invention with a constant-radius blade tip. Surface II is located halfway between Surface I and Surface III. The blade thickness characteristics $t_{max}$, $x_{tmax}$, $r_{le}$, $t_{te}$, and the non-dimensional thickness distribution at the sections cut by each of these surfaces are defined to be those of a blade of constant thickness characteristics with respect to radius the intersection of which by the surface of revolution is identical to that of the blade. FIG. 6*b* shows the increase in maximum blade thickness at the sections cut by the three surfaces. In the case shown, the increase in maximum thickness is proportional to the square of the distance from the beginning of the thickness increase.

Figure 7A:
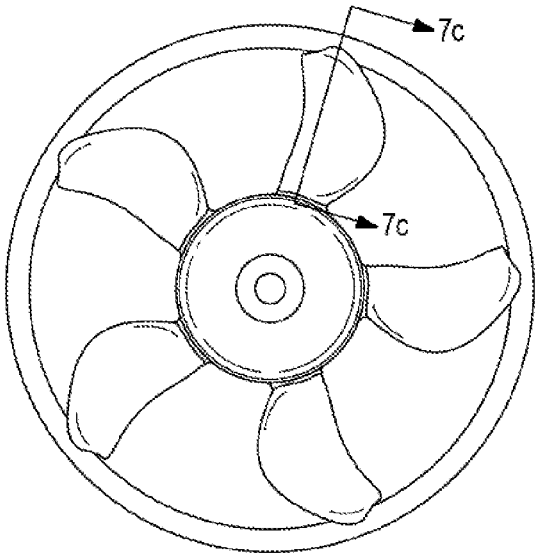
FIG. 7*a* is an axial view of the suction side of a fan according to the present invention whose blade tips conform to a flared shroud barrel, which is also shown.
Figure 7B:
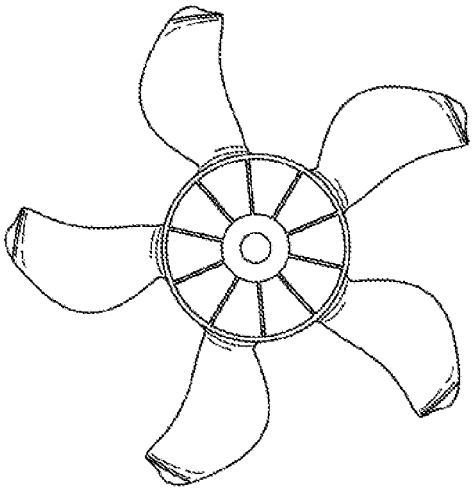
FIG. 7*b* is an axial view of the pressure side of the fan of FIG. 7*a*.
Figure 7C:
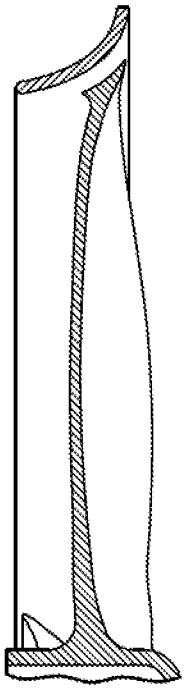
FIG. 7*c* is a meridional section through the blade and shroud barrel, at an angle corresponding to the point of maximum thickness at the blade tip, as indicated in FIG. 7*a*.
Figure 7D:
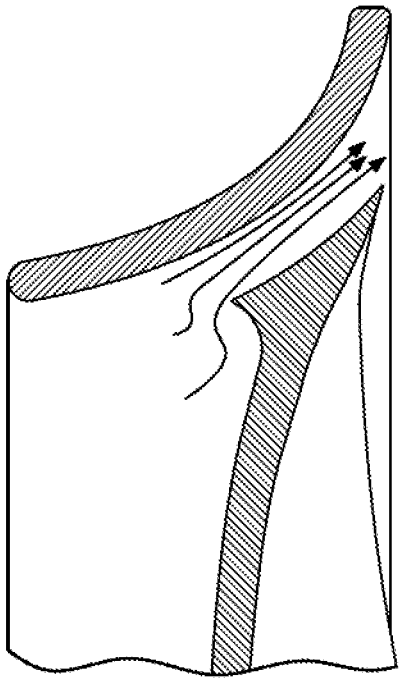
FIG. 7*d* is a detailed view of the tip region of FIG. 7*c*.
Figure 7E:
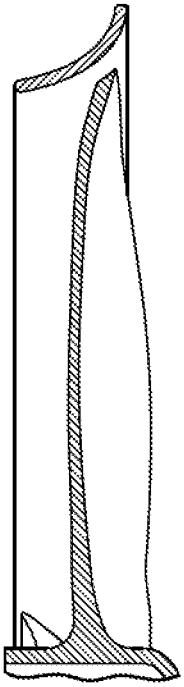
FIG. 7e PRIOR ART
FIGS. 7*e* and 7*f* are views of a prior-art fan which correspond to FIGS. 7*c* and 7*d*, respectively.
Figure 7F:
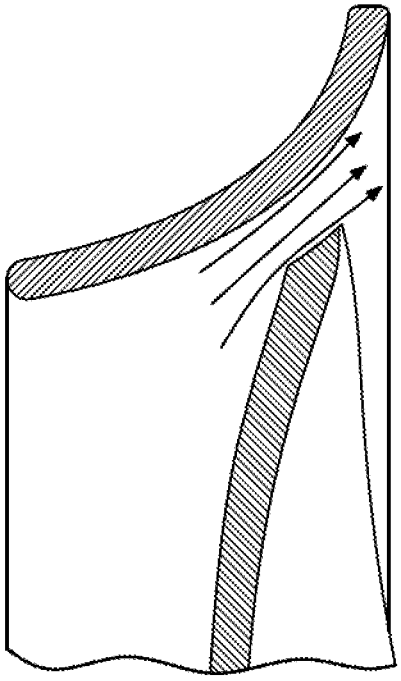
FIG. 7f PRIOR ART
Figure 7H:
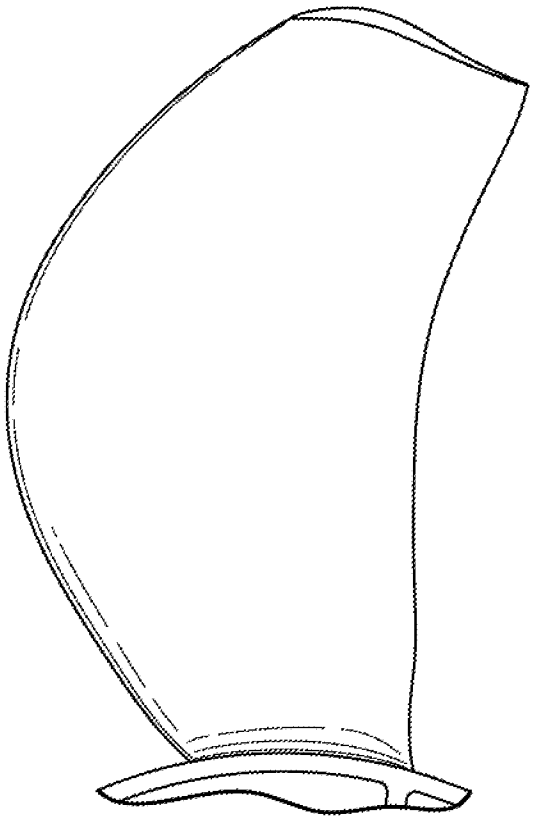
FIG. 7h PRIOR ART
FIG. 7*h* an axial view of the pressure side of a single blade of the prior-art fan.
Figure 7G:
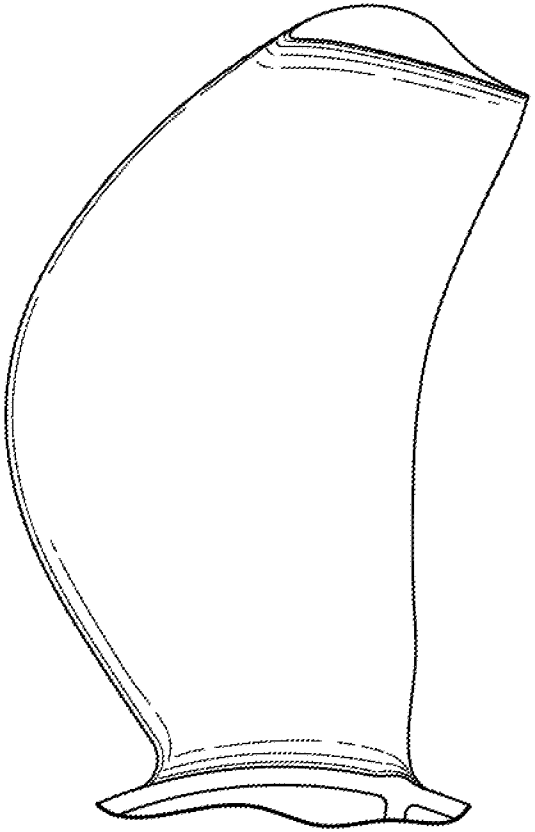
FIG. 7*g* is an axial view of the pressure side of a single blade of the fan according to the present invention.

FIG. 7*a* shows an axial view of the suction side of a fan according to the present invention whose blade tips conform to a flared shroud barrel, which is also shown. The thickness increase is a function of distance from the blade tip. This fan has an increased thickness distribution in the region within 0.025 R of the blade tip, and a thickness at the blade tip approximately three times the thickness at the start of the thickness increase. FIG. 7*b* shows an axial view of the pressure side of the fan. FIG. 7*c* is a meridional section through the blade and shroud barrel, at an angle corresponding to the point of maximum thickness at the blade tip, as indicated in FIG. 7*a*. FIG. 7*d* is a detailed view of the tip region of this section, showing the shape of the leakage path between the pressure and suction sides of the blade. In particular, it shows a sharp angle at the entrance to the leakage path, which may encourage separation of the leakage flow, and a reduced leakage flow rate. Possible leakage streamlines are shown schematically. FIGS. 7*e* and 7*f* show equivalent views of a prior-art fan which differs from the fan of FIGS. 7*c* and 7*d* only in that it does not have an increase in thickness near the blade tip. Here the leakage path is much shorter, and there is no sharp angle at the entrance. Possible leakage streamlines are shown. FIG. 7*g* is an axial view of the pressure side of a single blade of the fan of FIGS. 7*a*-7*d*, and FIG. 7*h* is an equivalent view of the prior-art fan of FIGS. 7*e* and 7*f*. It can be seen that the blade tip of a fan according to the present invention can have a significant axial projected area, unlike the blade tip of a prior-art fan.

Figure 8A:
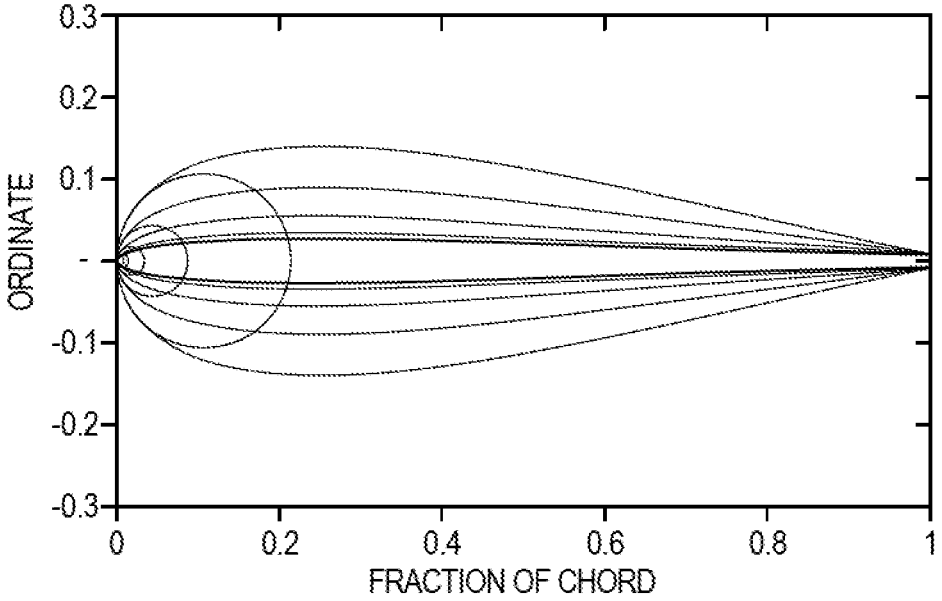
FIGS. 8*a* and 8*b* show blade thickness distributions, for two fans according to the present invention, at different positions within the region of increased thickness.
Figure 8B:
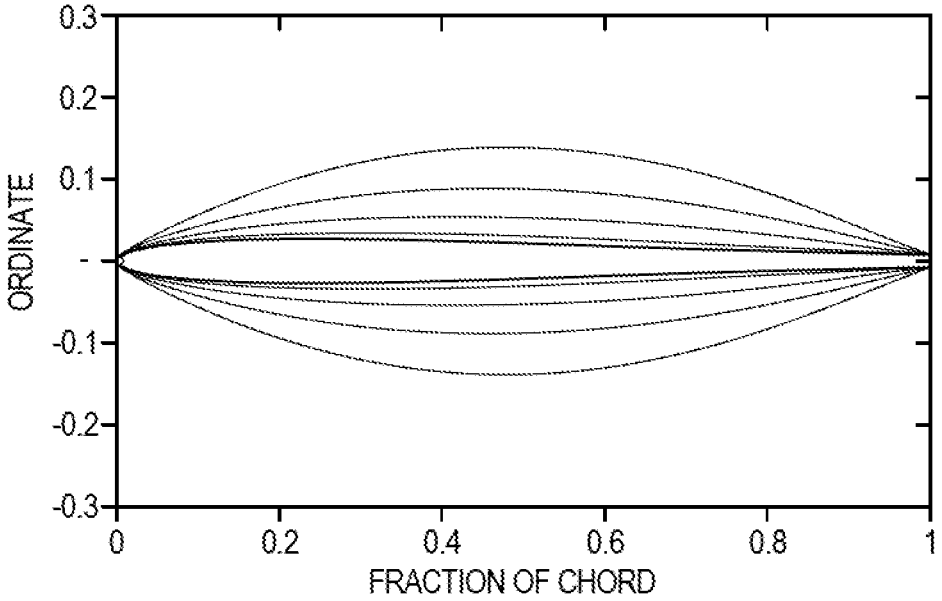
Figure 9A:
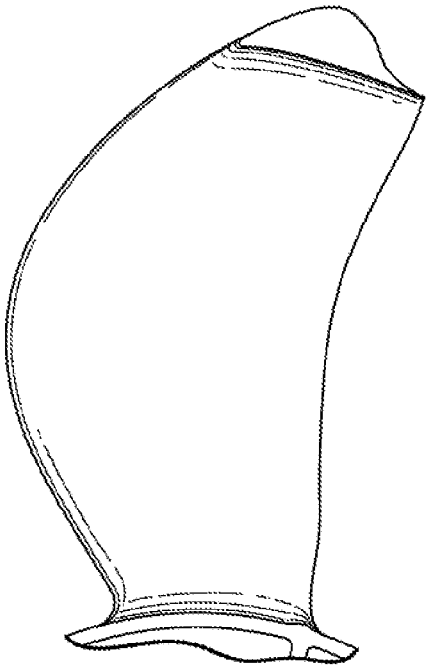
FIGS. 9*a* and 9*b* are axial views of the pressure side of a single blade of two fans according to the present invention whose blade tips conform to a flared shroud barrel, where the thickness distributions in the region of increased thickness at the tip are shown in FIGS. 8*a* and 8*b*, respectively.
Figure 9B:
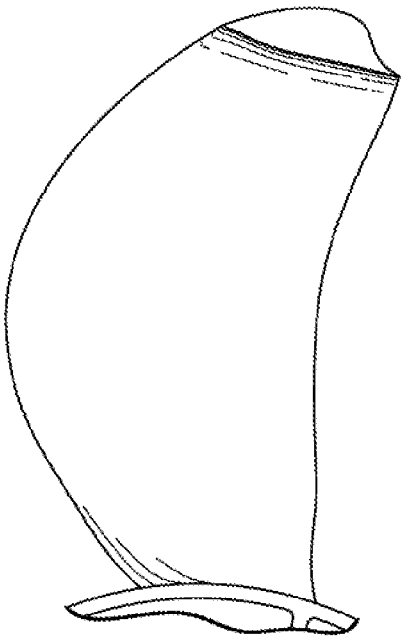

FIG. 8 shows plots of possible thickness distributions at 5 equally spaced positions in the region of thickness increase at the tip of a fan according to the present invention. The abscissa in each plot is chordwise position, against which is plotted the thickness ordinate (half-thickness) divided by chord. In each case the starting thickness is 0.052 times the chord, and the maximum thickness, representing the blade tip, is 0.281 times the chord. In FIG. 8*a* the non-dimensional thickness distribution is similar at all positions within the thickened region. This means that as the maximum thickness changes with position relative to the blade tip, the thickness at any chordwise position is approximately the same fraction of the maximum thickness. The exception is the trailing-edge region, where the thickness of a thicker section is relatively small compared to the maximum thickness. In FIG. 8*a* the trailing-edge thickness is the same regardless of the maximum thickness. A non-increasing trailing-edge thickness has been found to reduce aeroacoustic noise compared to the case where the trailing-edge thickness increases proportionally with the maximum thickness. Also plotted for each section is a circle whose radius is equal to the leading-edge radius. It can be seen that in FIG. 8*a*, the leading-edge radius grows approximately as the square of the maximum thickness. Plotted in FIG. 8*b* is a similar plot where the non-dimensional thickness distribution changes significantly within the region of thickness increase. In this case, the leading-edge radius is held constant as the maximum thickness increases. As a result, the chordwise position of the point of maximum thickness moves toward the trailing edge as the thickness is increased. FIGS. 9*a* and 9*b* show axial views of the pressure side of fan blades with the thickness distributions of FIGS. 8*a* and 8*b*, respectively. Both blades have an increased thickness in the region within 0.025 R of the blade tip, and a thickness at the blade tip approximately five times the thickness at the start of the thickness increase. It can be seen that the shapes of the blade tips in these figures is quite different. Although only two sets of thickness distributions are shown, many alternative sets can be used with good results.

Figure 10A:
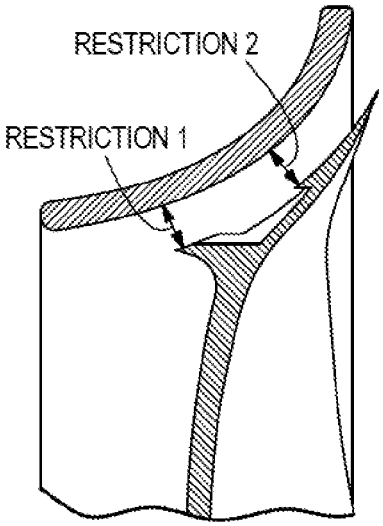
FIGS. 10*a* and 10*b* illustrate details of a fan according to the present invention whose blade tips conform to a flared shroud barrel where the blade tips are hollowed out.
Figure 10B:
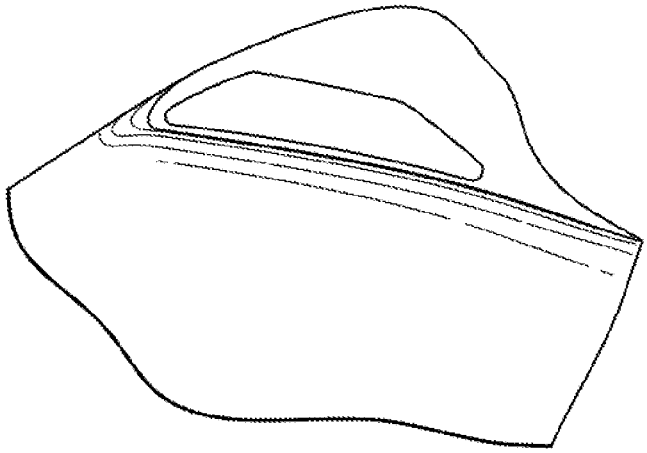

One embodiment of the present invention is a fan whose blade tips conform to a flared shroud barrel and where the thickness increase is a function of distance from the blade tip, where the blade tips are hollowed out. This embodiment is shown in FIG. 10. FIG. 10*a* shows a meridional section through the tip region of a blade and the shroud barrel, at an angle corresponding to the point of maximum thickness at the blade tip, as indicated in FIG. 10*b*. FIG. 10*b* shows an axial view of the pressure side of the blade tip region. The blade has an increased thickness in the region within 0.025 R of the blade tip, and a thickness at the blade tip approximately five times the thickness at the start of the thickness increase. The thickness distribution is as shown in FIG. 8*a*. One advantage of this embodiment is that it requires less material to mold the blade. Another possible advantage is that the leakage flow must navigate two separate restrictions as it passes between the blade and the shroud. Having two restrictions instead of one may increase the resistance to the leakage flow, and reduce the leakage flow rate. In the case of an injection-molded fan, a preferred embodiment achieves the hollow blade tip without adding action to the tooling. FIG. 10 shows such an embodiment.

Figure 11:
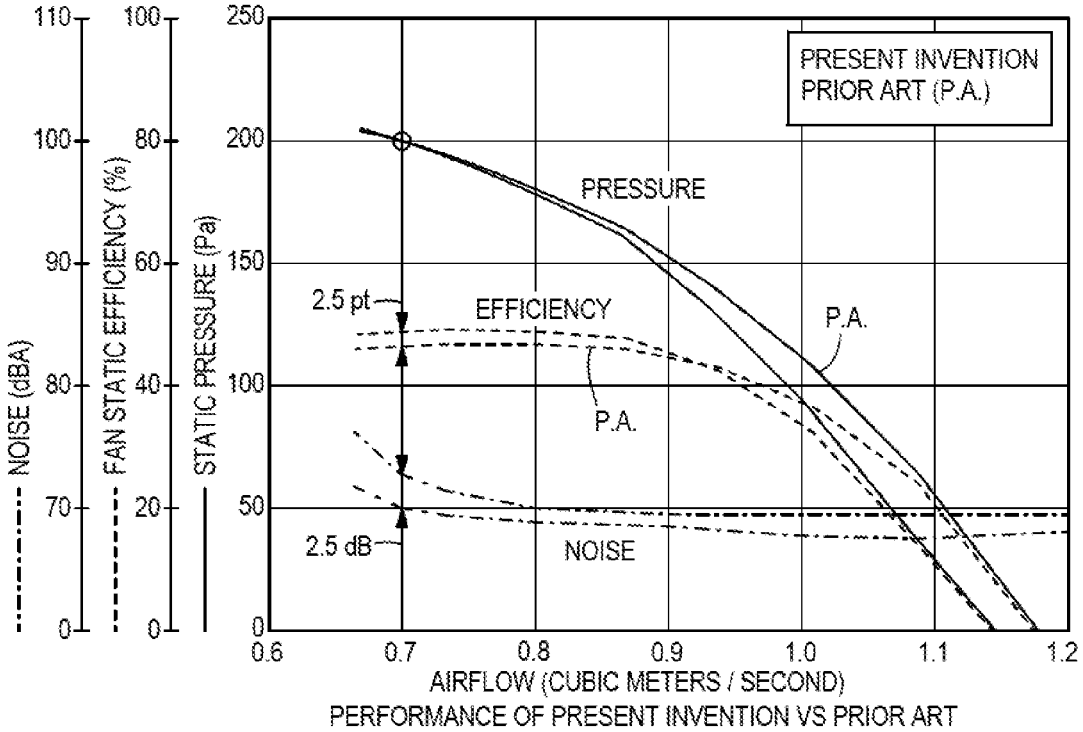
FIG. 11 is a plot of the performance of a fan according to the present invention compared to that of a prior-art fan which differs only in the thickness near the blade tip.

FIG. 11 shows the performance of a fan according to the present invention compared to that of the prior-art fan which differs only in the thickness near the blade tip. The fan diameter is 375 mm. The operating speed of both fans is adjusted to achieve a design flow of 0.7 $m^3/s$ at a pressure of 200 Pa, which represents the vehicle "idle" condition, where the vehicle is stationary. The speed of the prior-art fan is 2690 rpm, and that of the fan according to the present invention is 2671 rpm. At the design point, indicated by a small circle on the pressure curves, the fan according to the present invention has an efficiency 2.5 points higher and noise 2.5 dB less than the prior-art fan. There is a performance trade-off, however, in that the fan according to the present invention delivers less flow at "ram-air" conditions, where the effect of vehicle speed is to reduce the pressure developed by the fan.

Each of the embodiments of the present invention shown in the figures exhibits a significant increase in the blade thickness adjacent the blade tip. For example, a 100 percent or greater increase in maximum thickness may occur within a distance of the blade tip of 10 percent, 5 percent or even 2.5 percent of the blade tip radius. In some cases, a 200 percent or greater increase in maximum thickness may occur within a distance of the blade tip of 10 percent 5 percent or 2.5 percent of the blade tip radius.

Figure 12:
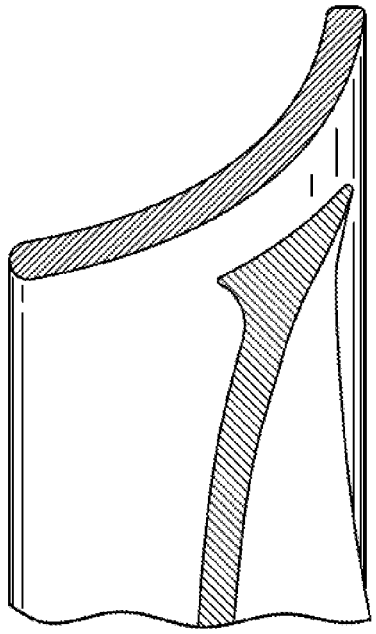
FIG. 12 is a detailed view of the tip region of a fan blade similar to that of FIG. 7*d* but having rounded blade tip edges.

Each of the embodiments of the present invention shown in the figures exhibits a blade thickness which increases monotonically or continuously from the start of the thickness increase to the blade tip. An advantage of this monotonic increase is that it typically leads to a sharp edge at the entrance to the leakage path, which may reduce the leakage flow rate. However, in other embodiments the increase in blade thickness may not be monotonic. In particular, the edges of the blade tip may be rounded slightly to reduce their sharpness. This may be advantageous for reasons of tooling, molding, or part handling. Even in the case of a blade tip with rounded edges (FIG. 12), the maximum blade thickness increases monotonically or continuously from the start of the thickness increase to a point where edge-rounding of the blade tip begins. Thus, the above description and figures, including specific examples, can all be applied to blades with rounded tip edges as alternate constructions.

A fan according to the present invention differs from a prior art fan only in that it has a revised thickness distribution. The blade angle and camber of the blade is unaffected. As a result, the overall performance of the fan at its design point is largely unaffected, except for an increase in efficiency, a decrease in noise, and a slight speed reduction. Other approaches to reducing flow through the tip gap often modify one side of the blade more than the other. These approaches in effect modify the mean line of the blade. Such a modification will in general change fan performance in a way that may not be anticipated, therefore requiring design iterations in order to achieve the original design point.

Another advantage of the present invention is that no additional geometric features are added to the fan, such as winglets, fences, or partial bands. When such additional geometries are added to a fan, parasitic losses and additional noise can be introduced which can offset the gains in efficiency and noise that are obtained from the reduction of flow through the tip gap.

U.S. Patent Application Publication No. 2011/0211949, the contents of which are incorporated by reference herein, discloses a change in blade camber and blade angle which acts to counteract the effect of the tip gap on the blade tip loading. Since the present invention does not involve any changes to the blade camber or blade angle, a fan can beneficially incorporate the claimed features of that application as well as the claimed features of the present invention.

Fan assemblies having properties according to one or more aspects of the present invention can be forward-skewed, back-skewed, radial, or of a mixed-skew design. Similarly, fan assemblies according to one or more aspects of the present invention can have any number of blades, any distribution of blade angle, camber, chord, or rake, and may be of either a pusher or a puller configuration.

What is claimed is:

1. A free-tipped axial fan assembly comprising:

a fan comprising a plurality of generally radially extending blades, each of the plurality of blades having a leading edge, a trailing edge, and a blade tip; and a shroud comprising a shroud barrel surrounding at least a portion of the blade tips with a tip gap being defined between the shroud barrel and the blade tips, wherein the fan has a blade tip radius R equal to the maximum radial extent of the blade tips measured at the trailing edge, and a diameter D equal to twice the blade tip radius R, wherein each of the plurality of blades has a sectional geometry which at each radius has a chord line extending between the leading edge and the trailing edge, a mean line that lies midway between opposing blade surfaces, and a thickness distribution along the mean line, where thickness is measured between the opposing blade surfaces, normal to the mean line at each position along the mean line, said thickness varying from the blade leading edge to the blade trailing edge, said thickness having a maximum value at at least one position of maximum thickness between the blade leading edge and the blade trailing edge, wherein a non-dimensional thickness distribution is defined at each radius to be the distribution of thickness divided by maximum thickness as a function of chordwise position, and wherein the maximum thickness of each of the plurality of blades exhibits a significant increase in a region adjacent the blade tip.

2. The free-tipped axial fan assembly of claim 1, wherein the shroud barrel is flared, the blade tip is shaped to conform to the shroud flare, and the blade tip leading edge is at a larger radius than the blade tip trailing edge, and wherein the maximum thickness, the trailing-edge thickness, and the thickness distribution at any distance from the blade tip within the region adjacent the blade tip are taken to be the maximum thickness, the trailing-edge thickness, and the thickness distribution of a blade with a maximum thickness, a trailing-edge thickness, and a thickness distribution which does not vary with radial position, the intersection of which by a surface of revolution offset by the distance from the surface of revolution swept by the blade tip, is identical to that of the blade.

3. The free-tipped axial fan assembly of claim 1, wherein the fan has constant-radius blade tips.

4. The free-tipped axial fan assembly of claim 1, wherein the maximum thickness of each of the plurality of blades at the blade tip is at least 100 percent greater than the maximum thickness of a blade section which is offset from the blade tip by a distance equal to 0.10 R.

5. The free-tipped axial fan assembly of claim 4, wherein the maximum thickness of each of the plurality of blades at the blade tip is at least 200 percent greater than the maximum thickness of a blade section which is offset from the blade tip by a distance equal to 0.10 R.

6. The free-tipped axial fan assembly of claim 1, wherein the maximum thickness of each of the plurality of blades at the blade tip is at least 100 percent greater than the maximum thickness of a blade section which is offset from the blade tip by a distance equal to 0.05 R.

7. The free-tipped axial fan assembly of claim 6, wherein the maximum thickness of each of the plurality of blades at the blade tip is at least 200 percent greater than the maximum thickness of a blade section which is offset from the blade tip by a distance equal to 0.05 R.

8. The free-tipped axial fan assembly of claim 1, wherein the maximum thickness of each of the plurality of blades at the blade tip is at least 100 percent greater than the maximum thickness of a blade section which is offset from the blade tip by a distance equal to 0.025 R.

9. The free-tipped axial fan assembly of claim 8, wherein the maximum thickness of each of the plurality of blades at the blade tip is at least 200 percent greater than the maximum thickness of a blade section which is offset from the blade tip by a distance equal to 0.025 R.

10. The free-tipped axial fan assembly of claim 1, wherein there is a smooth transition in thickness between an inner portion of the blade and the region of significant maximum thickness increase adjacent the blade tip.

11. The free-tipped axial fan assembly of claim 1, wherein the thickness increases monotonically to the blade tip within the region of significant maximum thickness increase adjacent the blade tip.

12. The free-tipped axial fan assembly of claim 1, wherein the increase in maximum thickness follows approximately the square of the distance from a position corresponding to a beginning of the thickness increase.

13. The free-tipped axial fan assembly of claim 1, wherein the non-dimensional thickness distribution at the blade tip is similar to the non-dimensional thickness distribution along the blade section at a position corresponding to a beginning of the thickness increase, with the exception of the trailing edge region, where the thicker sections near the blade tip have a relatively small non-dimensional trailing-edge thickness.

14. The free-tipped axial fan assembly of claim 1, wherein the non-dimensional thickness distribution at the blade tip has a position of maximum thickness which is closer to the trailing edge than that of the non-dimensional thickness distribution along the blade section at a position corresponding to a beginning of the thickness increase.

15. The free-tipped axial fan assembly of claim 1, wherein the trailing-edge thickness of the blade tip is approximately equal to the trailing-edge thickness of the blade section at a position corresponding to a beginning of the thickness increase.

16. The free-tipped axial fan assembly of claim 1, wherein the tip gap is greater than about 0.005 times the fan diameter D and less than about 0.02 times the fan diameter D.

17. The free-tipped axial fan assembly of claim 1, wherein the fan is injection-molded plastic.

18. The free-tipped axial fan assembly of claim 1, wherein the region adjacent to the blade tip is hollow.

19. The free-tipped axial fan assembly of claim 1, wherein the shroud barrel is flared, the blade tip is shaped to conform to the shroud flare, the blade tip leading edge is at a larger radius than the blade tip trailing edge, the fan is injection-molded, and the region adjacent to the blade tip is hollowed in such a way that action in the molding tool is not required.

20. A free-tipped axial fan assembly comprising:

a fan comprising a plurality of generally radially extending blades, each of the plurality of blades having a leading edge, a trailing edge, and a blade tip; and a shroud comprising a shroud barrel surrounding at least a portion of the blade tips with a tip gap being defined between the shroud barrel and the blade tips, wherein the fan has a blade tip radius R equal to the maximum radial extent of the blade tips measured at the trailing edge, and a diameter D equal to twice the blade tip radius R, wherein each of the plurality of blades has a sectional geometry which at each radius has a chord line and a thickness distribution, said thickness varying from the blade leading edge to the blade trailing edge, said thickness having a maximum value at at least one position of maximum thickness between the blade leading edge and the blade trailing edge, wherein a non-dimensional thickness distribution is defined at each radius to be the distribution of thickness divided by maximum thickness as a function of chordwise position, and wherein the maximum thickness of each of the plurality of blades exhibits a significant increase in a region adjacent the blade tip, and the maximum thickness increases continuously from an end of the region furthest from the blade tip to either a sharp blade tip edge or a point where edge-rounding of the blade tip begins.

* * * * *